United States Patent [19]

Anspach

[11] 4,136,881

[45] Jan. 30, 1979

[54] GAME EQUIPMENT AND METHOD HAVING SIMULTANEOUSLY PLAYED, BALANCED, MULTIPLE GAME THEORIES

[76] Inventor: Ralph Anspach, 1060 Keith Ave., Berkeley, Calif. 94708

[21] Appl. No.: 763,815

[22] Filed: Jan. 31, 1977

[51] Int. Cl.[2] ..... A63F 3/00

[52] U.S. Cl. ..... 273/256

[58] Field of Search ..... 273/134 AF, 134 AD, 273/134 AT, 134 C, 134 D, 134 E, 134 BD, 134 ER, 135 C, 135 AC, 135 AA, 135 R, 256, 243

[56] References Cited

U.S. PATENT DOCUMENTS

| | | | |
|---|---|---|---|
| 796,774 | 8/1905 | Thompson | 273/134 AD |
| 1,295,993 | 3/1919 | Kleissel | 273/131 AC |
| 1,631,505 | 6/1927 | Samis | 273/134 AD |
| 1,666,788 | 4/1928 | Palumbo | 273/134 AD |
| 2,026,082 | 12/1935 | Darrow | 273/134 ER |
| 2,976,044 | 3/1961 | Corpening | 273/134 AD |
| 3,148,886 | 9/1964 | Sharp | 273/134 AD |
| 3,163,423 | 12/1964 | Jackson | 273/134 D |
| 3,198,521 | 8/1965 | Kramer et al. | 273/134 AF |
| 3,367,662 | 2/1968 | Charles et al. | 273/134 AD |
| 3,565,437 | 2/1971 | Mitchell | 273/134 AD |
| 3,759,521 | 9/1973 | Breslow et al. | 273/134 C |
| 3,807,739 | 4/1974 | Henley et al. | 273/134 AD |
| 3,850,433 | 11/1974 | Purlia | 273/134 AD |
| 3,860,242 | 1/1975 | Martin | 273/134 C |
| 3,961,795 | 6/1976 | Anspach | 273/134 AD |
| 4,045,031 | 8/1977 | Arnold | 273/134 AD |

FOREIGN PATENT DOCUMENTS

| | | | |
|---|---|---|---|
| 253245 | 3/1963 | Australia | 273/134 CH |
| 1239755 | 7/1971 | United Kingdom | 273/134 AF |

OTHER PUBLICATIONS

"How To Win At 'Monopoly' (TM)"; *Saturday Review of the Sciences;* Apr. 1973; pp. 44–48.

*Primary Examiner*—Anton O. Oechsle
*Assistant Examiner*—Harry G. Strappello
*Attorney, Agent, or Firm*—Warren, Chickering & Grunewald

[57] ABSTRACT

Game equipment and a method are disclosed in which the equipment is formed for the simultaneous play of a game by at least two differing game theories. The game equipment includes probability determining means formed to substantially balance the probability of winning by either of the differing game theories. In a preferred form, a parlor type board game is disclosed in which business development or real estate trading is simulated with the game including simultaneous play by at least two players, with one playing under a monopolistic game theory and the other playing under a competitive game theory and each having an equal chance of winning.

12 Claims, 9 Drawing Figures

GAME EQUIPMENT AND METHOD HAVING SIMULTANEOUSLY PLAYED, BALANCED, MULTIPLE GAME THEORIES

BACKGROUND OF THE INVENTION

Games of all kinds have heretofore had a common characteristic, namely, they are played by players who are guided by a unitary game conduct controlling theory. Thus, whether in team games such as baseball, football, basketball and the like, or individual games such as chess or checkers, or the host of parlor type games available in today's market, the game players compete against each other using the same set of rules. This approach, of course, has a logical appeal and insures fairness to all players.

In recent years computer technology has been extensively employed to analyze and assist scientists in connection with a wide range of subjects including, to a limited degree, the play of games. To the extent that this technology has heretofore been brought to bear upon game playing, it has largely taken the form of computer analysis. Perhaps the best example of the use of computers in connection with the analysis of games is contained in an article in *Saturday Review of Sciences,* by Irwin R. Hentzel (April, 1973). This article sets forth a computer analysis of the well known board game sold under the trademark MONOPOLY. From this computer analysis, the probabilities of landing on any individual space on the board as well as the returns to the players as a function of their investment and these probabilities have been analyzed. Similarly, numerous computer programs have been generated for the play of chess games, and competition by chess experts against these problems has been employed as a training and analysis tool.

In the area of parlor games and particularly business related parlor games, many attempts have been made to simulate actual business conditions and practices. While such simulations in game form have met with varying degrees of success, they have also had a common defect, namely, all the players play by the same set of rules. This approach has limited the ability to simulate actual business conditions since in real life the "players" operate under differing rules of conduct.

Typical of some of the prior art board games which simulate various business endeavors are the games set forth in U.S. Pat. Nos. 1,666,788; 2,976,044; 3,163,423; 3,198,521; 3,367,662; 3,565,437; 3,807,739 and 3,850,433. These games range from rather abstract races around a path to business game simulations for the stock market, discount stores, real estate development, and even invention development, protection and promotion. Each of these parlor games, however, is constructed with game apparatus in which the play of the game by all players is under a single uniform set of game conduct determining rules and parameters. Players can elect at these games to do or not do certain things, but all players at least theoretically will have an opportunity to make the same elections.

The disadvantage of having a single game theory under which all players in a game must play can be illustrated by reference to further prior art patents. The first of these patents is U.S. Pat. No. 2,026,082, which discloses the board game sold under the trademark MONOPOLY and my prior U.S. Pat. No. 3,961,795, which sets forth the board game sold under the trademark ANTI-MONOPOLY. The game play with the game apparatus set forth in the MONOPOLY patent simulates the development of real estate and utilities by means of a monopolistic approach or theory. Thus, the return on the money invested is disproportional to the investment once all of a group of properties is acquired. In fact, however, most real estate and business developments today, although admittedly not all, are developed under competitive theories, namely, the return on investment is proportional to the investment. In a monopolistic theory, the monopolist corners a real estate development and charges exhorbitant rents as a result of his monopolistic position. One could vary the play of the game equipment disclosed in U.S. Pat. No. 2,026,082 by simply changing the return from a monopolistic return to a competitive or proportional return on an investment. Such a change in the game would allow simulation of the activities of competitors in developing real estate and utilities, but it would still fall short of simulating both competitive and monopolistic practices, which in fact are present in today's market.

With respect to the game of ANTI-MONOPOLY set forth in my prior U.S. Pat. No. 3,961,795, the basic game theory is to win the game by breaking up illegal combinations of business entities such as monopolies, oligopolies, and business trusts. There is, however, a single method or set of parameters which controls the way players can break up these anti-competitive combinations, when in real life there are numerous approaches through the private and public sectors which can be used to challenge such illegal combinations. Each approach has with it attendant risks and benefits, but the game simulation of my prior patent basically employs a single theory which is a mix of private sector and public sector tools and techniques for breaking up these anti-competitive practices.

Additionally, in the "real world" while some "players" are attempting to build fortunes through either competitive or monopolistic practices, other "players" are attempting to eliminate illegal practices. Thus, the simulation of U.S. Pat. No. 2,026,082 and of U.S. Pat. No. 3,961,795 are further limited to opposite sides of the coin. There are not, for example, players who attempt to build fortunes through monopolistic practices while other players are attempting to prevent monopolistic combinations. Such a simultaneous simulation of market practices would be most interesting and much more realistic than either of the games alone.

OBJECTS OF THE INVENTION

Accordingly, it is an object of the present invention to provide game equipment and a method which is constructed in a manner permitting the simultaneous play of two differing game theories on a single game format.

It is another object of the present invention to provide game equipment for the simultaneous playing of a multiplicity of game theories with the probability of winning the game under each game theory being substantially balanced.

It is a further object of the present invention to provide game equipment contructed in a manner enabling use of the same to simulate business board games in which some players play in accordance with monopolistic principles while other players play in accordance with competitive principles.

Still another object of the present invention is to provide a game constructed in a manner which enables the play of a game in which the risks and benefits accruing to one player differ from the risks and benefits accruing to another and yet equally skilled players have the same chance of winning.

Still a further object of the present invention is to provide a parlor type board game in which monopolistic and anti-monopolistic theories of play are simultaneously employed.

Still a further object of the present invention is to provide game equipment which is constructed in a manner to provide games which simulate in a greater degree real life models, are easy to learn and play, afford greater variety and more interest during play, are easy to construct, are durable and have a minimum number of pieces.

The game equipment and method of the present invention have other objects and features of advantage which will become apparent from and are set forth in more detail in the following description and accompanying drawing.

SUMMARY OF THE INVENTION

Game equipment and a method are disclosed which include a game format means and a plurality of player indentification means formed for use with the format means. In the improved game equipment of the present invention, there is further provided probability determining means formed for simultaneous play of a game by at least two differing game conduct controlling theories. Moreover, it is preferable that the probability determining means is further formed so that the probability of winning the game under any game controlling theory is substantially equal to the probability of winning the game under any other theory. The game equipment may be advantageously formed for simultaneous play of business-type board games and more particularly board games of the type in which real estate, utilities, transportation companies and other business entities are invested in and produce returns on either a monopolistic or competitive basis. Alternatively, the monopolistic practices of businesses can be broken up under either a conservative but more certain approach or a higher risk and faster approach. Finally, game theories such as monopolistic development of real estate and anti-monopolistic breaking up of monopolies can be combined in a single game.

DESCRIPTION OF THE PREFERRED EMBODIMENT

Figure 1:
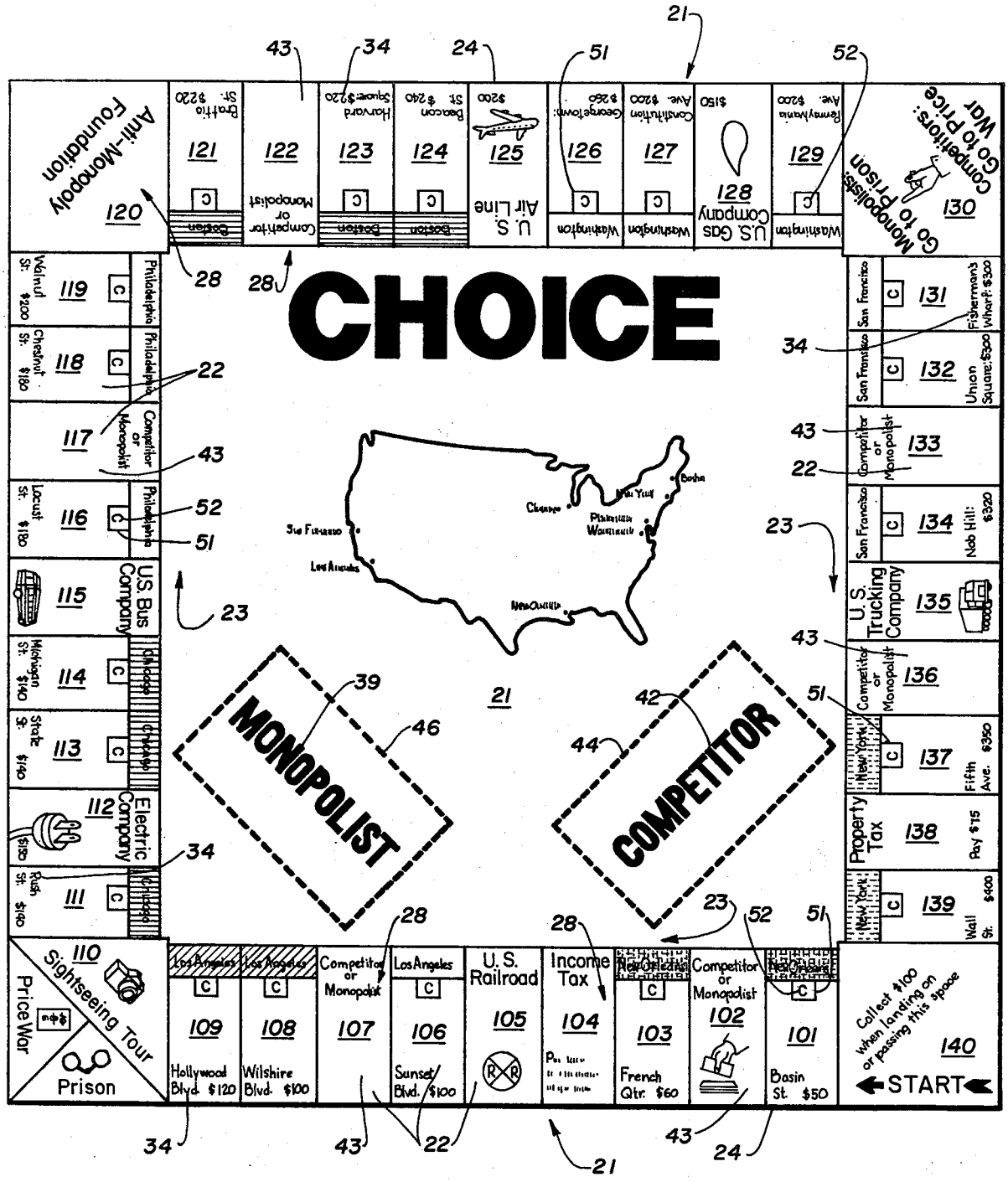
FIG. 1 is a top plan view of a game board constructed in accordance with the game equipment of the present invention.

The game equipment of the present invention includes game format means which can take several forms but is shown in FIG. 1 as a game board 21 of the type conventionally employed in connection with parlor games. The advantages of the present invention will still be seen to accrue if the format means takes a form other than a game board, but the present invention is particularly well suited for use with a game board 21 having spaces 22 thereon arranged in a path, generally designated 23, which preferably extends continuously around the periphery 24 of board 21. As also will become apparent, in its broadest form, the present invention does not require the use of a continuous path comprised of a plurality of spaces.

Figure 2:
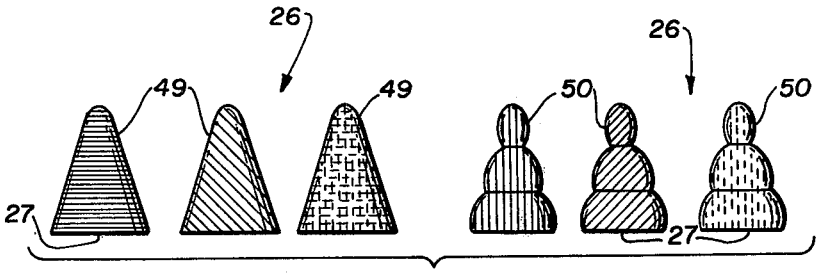
FIG. 2 is a front elevational view of playing pieces suitable for use with the game equipment of the present invention.

In addition to including format means, the game equipment of the present invention includes a plurality of player indentification means, generally designated 26, and shown in FIG. 2. Player identification means 26 are formed for use with format means, for example, by forming player identification means 26 with planar surfaces 27 so that they may be rested upon the board 21 during play of the game. As thus far described, the game equipment includes conventional elements found in most parlor games and many other types of games.

In the improved game equipment of the present invention, in order to provide for a more interesting and realistic game simulation, probability determining means, generally designated 28 (FIGS. 1, 3, 4 and 5), are provided, which probability determining means is formed for simultaneous play of a game by at least two differing game conduct controlling theories. When the game format takes the form of a game board 21 of the type shown in FIG. 1, probability determining means 28 can be incorporated into several portions of the game equipment including selected of the spaces 22 on the board 21, title cards 29 show in FIG. 3, and detriment and benefit cards 31 and 32 shown in FIGS. 4 and 5. The combination of such probability determining means results in the game equipment being formed for play of a game by two differing game theories.

The simplest to understand illustration of the formation of probability determining means 28 for play under two differing game theories is shown by title card 29 and detriment and benefit cards 31 and 32. As will be seen in FIG. 3, title card 29 includes a distinct title indicia 33 corresponding to a distinct title indicia 34 positioned proximate, in this case on, selected ones of spaces 22 comprising the path 23 on the board. Additionally, title card 29 is formed with a first set of directions 36 which affect play by the players. In this case, the spaces 22 on the game board represent real estate or business enetities which can be improved, and the first set of directions 36 on title card 29 is a schedule of rents charged to opposing players when they land on the property, with the rents increasing in amount as the property is improved. As used herein, title card 29 also acts as reference means and the schedule or first set of directions 36 is also referred to as part of first probability determining means which control the game in accordance with a first game theory.

Figure 3:
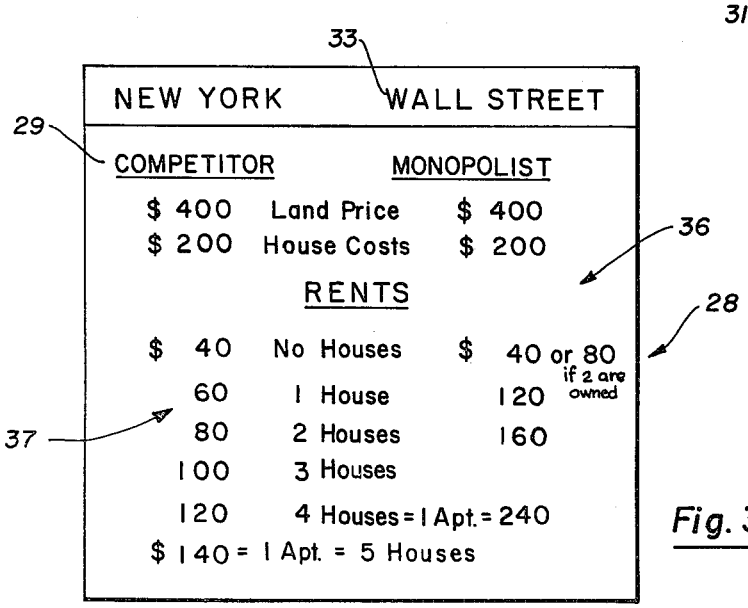
FIG. 3 is a top plan view of a title card.

The title card of FIG. 3, as thus far described, is of the same general type as can be found in the board game sold under the trademark MONOPOLY. In the present invention, however, in order to provide probability determining means formed for the simultaneous play of a game by two differing game theories, title card 29 is further provided with a second probability determining means, namely, a second schedule or set of directions 37 which is printed on the title card and which directions differ from the first probability determining schedule 36 on the title card. Schedule 37, as will be seen, also sets forth rental fees for the same property or business entity as a function of the improvements placed upon the property. The rental received, however, differs from the first schedule 36. As will be appreciated, it would be possible to provide two decks of title cards instead of a single title card with two schedules thereon.

Figure 5:
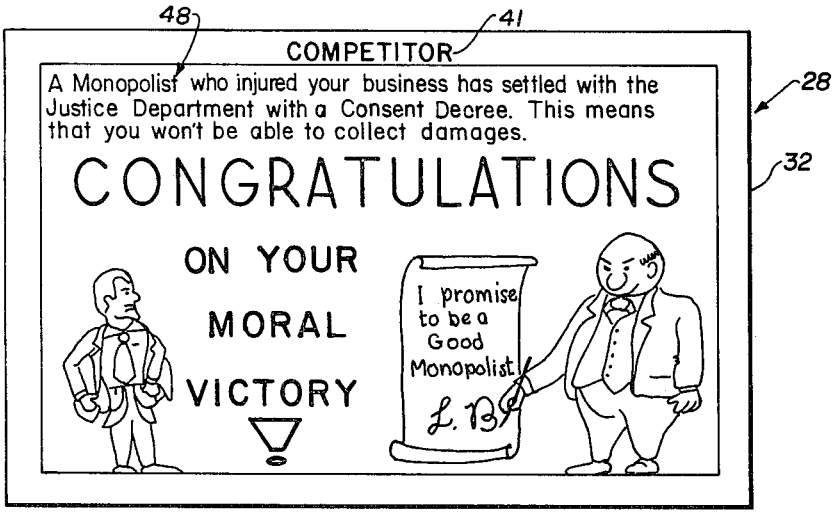
FIG. 5 is a top plan view of a detriment or benefit card for competitors.
Figure 4:
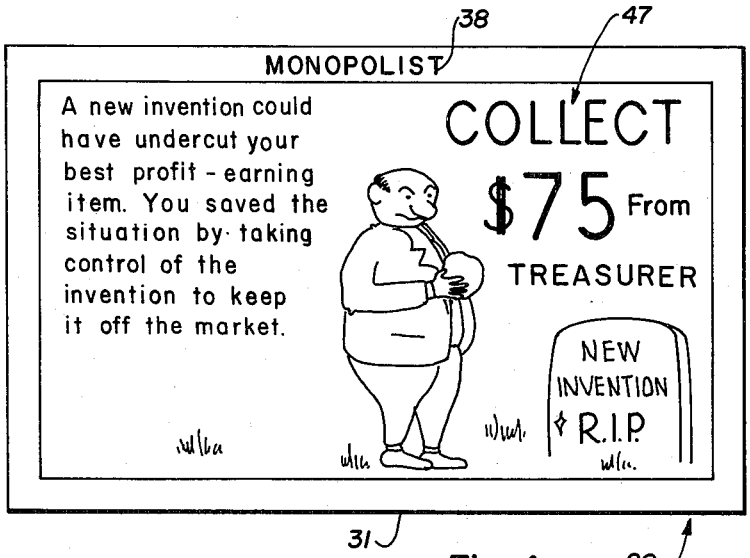
FIG. 4 is a top plan view of a detriment or benefit card for monopolists.

The probability determining means for the board game of FIG. 1 includes not only title cards 29, but the detriment and benefit cards 31 and 32 shown in FIGS. 4 and 5. Detriment card 31 is provided with indicia 38 thereon which corresponds to indicia 39 on the board 21. Similarly, indicia 41 is provided on detriment and benefit card 32 and corresponds to indicia 42 on the board. As is the case with board games of the type similar to MONOPOLY, the path 23 of spaces includes selected spaces 43 which when landed upon require the player to take a detriment or benefit card. In the game equipment of the present invention, the player selects one of the detriment or benefit cards of FIGS. 4 and 5. The cards are placed face down in a deck on the board at the spaces delineated on the board at 44 and 46, and the selection is made in accordance with the role or game theory played by the player and the corresponding indicia on the cards and the board. If a player is playing the game in accordance with a first game theory (e.g., monopolist), he will select a card from the space bearing the indicia 42, while a player playing the game under a second game theory (e.g., competitor) would, when landing on the same space 43, select a card from the space marked with indicia 39. The cards 31 and 32 bear directions 47 and 48 which affect either the movement of the playing piece or confer a detriment or benefit on the player.

Additionally, further reference means, such as a set of rules (not shown) can be provided which set forth action which the player must take or detriments and benefits which accrue to the players when landing on selected spaces 22 on the board. These actions and detriments and benefits can differ as between the differing game theories each player is playing under.

Thus, in the board game set forth, the first probability means would include the first schedule 36 plus the deck of detriment and benefit cards 31 containing directions and detriments and benefits to the players and the detriments and benefits in the rules corresponding to the first game theory. The second probability means includes the schedule 37 on the deck of title cards 29 plus the instructions 48 contained on the detriment and benefit cards 32 and any detriments and benefits in the rules pertaining to the second game theory.

Player identification means or playing pieces 26 are preferably color coded, as is shown in FIG. 2, so that each playing piece can be distinguished from the other. In addition, first player identification means or playing pieces 49 have a shape which distinguishes them from second player identification means or playing pieces 50. The distinguishing shape as between playing pieces 49 and 50 is used to identify the players who are playing under a first game theory and distinguish them from the players who are playing under a second game theory. For purposes of illustration, the two game theories under which the board game is played are designated as a "monopolistic" game theory and a "competitive" game theory. Accordingly, a monopolistic player will select one of game pieces 49 while a competitive player will select one of game pieces 50.

Figure 9:
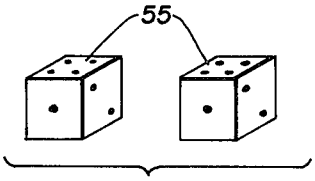
FIG. 9 is a top perspective view of dice.
Figure 8:
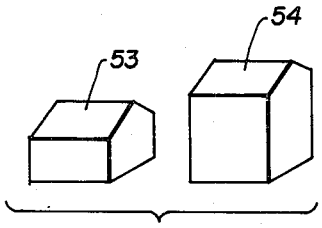
FIG. 8 is a top perspective view of improvement symbolizing elements.

The game equipment of the present invention further includes chance determining or playing piece advancement means, preferably a conventional pair of dice 55 shown in FIG. 9. Each of the players is preferably given the same amount of money, although it will be appreciated that the probability determining means could include a differing starting bank roll depending upon the game theory employed. This starting difference could be made up or balanced by other detriments and benefits conferred after start-up. Each of the players will attempt to acquire and improve the property or businesses as represented by selected spaces around the board. The players take turns rolling the dice, and when they land on a business or property space, they can use their money to acquire the property. If they elect to acquire the property, they will be given a title card 29 corresponding to the piece of property acquired. The players will also be able to use their money to improve the property so that they can charge rent to opposing players who land on the property. Play continues until the winner is determined, usually when one player has bankrupted the other players or has the most money at the end of a given period of time. The monopolist and competitor, however, simultaneously play the same game by game theories which differ and are controlled by first and second probability determining means.

As thus far described, the game equipment of the present invention, represents a substantial departure and improvement over prior game equipment. It is further an important aspect and feature of the present invention, however, that the probability determining means be formed so that the probability of winning the game under the two game theories is substantially equal. Thus, if the first and second probability determining rent schedules 36 and 37, when combined with the detriment and benefit cards and the detriments and benefits in the rules always favored either the monopolist or the competitor, the game would be won upon the initial determination of who would play as a monopolist and who would play as a competitor.

The balancing of the probability of winning by any one of a multiplicity of differing game theories can most readily be accomplished by a computer implementation and analysis. Thus, as is set forth in the *Saturday Review of Sciences* article, the probability of landing on any one of the 40 spaces on board 21 can be calculated when one considers factors such as the position of detriment and benefit squares 43, the type of chance determining means employed, the instructions contained on detriment and benefit cards 31 and 32 as to the movement of players, and the effect of rolling doubles, as well as rules with respect to the spaces marked "jail" and "price war." The typical business type board games use detriment and benefit cards 31 and 32 to bring in or pump money into the game as the players go around the board. Thus, these cards can also be employed in combination with rent schedules 36 and 37 and rules differences to balance the return which players receive. Thus, a computer can combine the probability of landing on each of the squares with a rent schedule that differs between monopolists and competitors and further with a building rule which allows competitors to build earlier and finally balance the likelihood or probability of winning by varying the amount of money which is pumped or added to the competitor or monopolist by means of the detriment and benefit cards and detriment and benefit spaces on the board. The result will be that monopolists and competitors have substantially the same chance or probability of winning the game, and the outcome will be determined by whether or not they maximize the return under their respective game theories and as a matter of chance, but not by the game theory under which they select to play the game.

EXAMPLE

By way of illustration, the following is a further detailed example of a business type board game of the same general type as the game sold under the trademark MONOPOLY, but in the present game the probability determining means are formed so that the probability of winning has been balanced or is substantially equal for each of two differing game conduct controlling theories or principles.

The players are given a budget or starting bankroll of $1500 and at least one player is selected to play as a monopolist while another is a competitor. The players should be evenly divided as between competitors and monopolists or if there is an uneven number, no more than one more monopolist or one more competitor should exist. Selection of the roles can be determined by agreement or by rolling dice.

The 40 spaces on the board of FIG. 1 have been numbered for identification beginning with the number 101 through the number 140. These numbers are used in the following Table 1 which sets forth the space number, cost of acquisition, cost of improvements and rents charged by monopolists and by competitors.

example, houses 53 and apartment houses 54, could also come in two sets which are either color coded or have differing shapes or appearances (providing improvement indicia), with one of the sets being used by competitors and the remaining set being used by monopolists.

In the board game of the present invention it is further preferable that the spaces 22 which are designed to represent pieces of real property be grouped by color and/or other indicia into groups representing selected cities in the United States. Thus, as will be seen in FIG. 1, the first grouping of real properties, spaces 101 and 103, have the designation "New Orleans" on the top thereof as well as a color code, in this case yellow. At the bottom of the space street names 56 are also set forth, in this case "Basin St." and "French Quarter." Optionally, and for the sake of convenience, the purchase price 57 can also be indicated on the space. In a similar manner, spaces 106, 108 and 109 are indicated as being streets in the city of Los Angeles, spaces 111, 113 and 114 are city streets in the city of Chicago, spaces 116, 118 and 119 are city streets in the city of Philadelphia, spaces 121, 123 and 124 are city streets in the city of Boston, spaces 126, 127 and 127 are city streets in the city of Washington, spaces 131, 132 and 134 are city streets in the city of San Francisco, and spaces 137 and 139 are city streets in the city of New York. This feature of the apparatus of the present invention gives the game a geographic relevancy that is not present in games in

TABLE 1

| | | | Rents Charged by COMPETITOR | | | | | | Rents Charged By MONOPOLIST | | | | |
|---|---|---|---|---|---|---|---|---|---|---|---|---|---|
| | | | Houses | | | | | | Houses | | | | |
| Space No. | Cost of Acquisition | Cost of Houses | Unimproved | 1 | 2 | 3 | 4 | Apartment | Unimproved | 1 | 2 | 3 | Apartment |
| 101 | $60 | $50 | $6 | $11 | $16 | $21 | $26 | $31 | $12 | $22 | $32 | $42 | $52 |
| 103 | 60 | 50 | 6 | 11 | 16 | 21 | 26 | 31 | 12 | 22 | 32 | 42 | 52 |
| 106 | 100 | 50 | 10 | 15 | 20 | 25 | 30 | 35 | 20 | 30 | 40 | 50 | 60 |
| 108 | 100 | 50 | 10 | 15 | 20 | 25 | 30 | 35 | 20 | 30 | 40 | 50 | 60 |
| 109 | 120 | 50 | 12 | 17 | 22 | 27 | 32 | 37 | 24 | 34 | 44 | 54 | 64 |
| 111 | 140 | 100 | 14 | 24 | 34 | 44 | 54 | 64 | 28 | 48 | 68 | 88 | 108 |
| 113 | 140 | 100 | 14 | 24 | 34 | 44 | 54 | 64 | 28 | 48 | 68 | 88 | 108 |
| 114 | 160 | 100 | 16 | 26 | 36 | 46 | 56 | 66 | 32 | 52 | 72 | 92 | 112 |
| 116 | 180 | 100 | 18 | 28 | 38 | 48 | 58 | 68 | 36 | 56 | 76 | 96 | 116 |
| 118 | 180 | 100 | 18 | 28 | 38 | 48 | 58 | 68 | 36 | 56 | 76 | 96 | 116 |
| 119 | 200 | 100 | 20 | 30 | 40 | 50 | 60 | 70 | 40 | 60 | 80 | 100 | 120 |
| 121 | 220 | 150 | 22 | 37 | 52 | 67 | 82 | 97 | 44 | 74 | 104 | 134 | 164 |
| 123 | 220 | 150 | 22 | 37 | 52 | 67 | 82 | 97 | 44 | 74 | 104 | 134 | 164 |
| 124 | 240 | 150 | 24 | 39 | 54 | 69 | 84 | 99 | 48 | 78 | 108 | 138 | 168 |
| 126 | 260 | 150 | 26 | 41 | 56 | 71 | 86 | 101 | 52 | 82 | 112 | 142 | 172 |
| 127 | 260 | 150 | 26 | 41 | 56 | 71 | 86 | 101 | 52 | 82 | 112 | 142 | 172 |
| 129 | $280 | $150 | $28 | $43 | $58 | $73 | $88 | $103 | $56 | $86 | $116 | $146 | $176 |
| 131 | 300 | 200 | 30 | 50 | 70 | 90 | 110 | 130 | 60 | 100 | 140 | 180 | 220 |
| 132 | 300 | 200 | 30 | 50 | 70 | 90 | 110 | 130 | 60 | 100 | 140 | 180 | 220 |
| 134 | 320 | 200 | 32 | 52 | 72 | 92 | 112 | 132 | 64 | 104 | 144 | 184 | 224 |
| 137 | 350 | 200 | 35 | 55 | 75 | 95 | 115 | 135 | 70 | 110 | 150 | 190 | 230 |
| 139 | 400 | 200 | 40 | 60 | 80 | 100 | 120 | 140 | 80 | 120 | 160 | 200 | 240 |

As will be seen from Table 1, the competitor can improve his property by adding five levels of improvement, namely, four houses and then the addition of an apartment house. The monopolist can improve the same property by adding only three houses and then an apartment house. For the sake of clarity, it is preferable that each of the spaces which can be improved by houses or apartment houses be formed with an area 51 having an improvement indicia 52 positioned therein, which relates to one of the monopolists or competitors, in this case the letter "C" standing for competitor. Any time a competitor builds on a property, he must place his first improvement, or eventually his apartment house, on the space 51. This will allow the players to visually distinguish the properties owned by competitors and monopolists. As will be appreciated, the elements or improvement which are used to represent the improvements, for which the city streets are based upon a single geographically remote city. As will be understood, the city streets can be selected from any number of cities throughout the United States. It is even possible for a player to modify his game equipment to provide for city streets in the area of his own locality.

In addition to the difference in the rental schedules and the number of improvements which may be placed on the property as developed by a competitor and a monopolist, the rules, additional reference means for the game, provide that a monopolist must have at least two of the three, if there are three, city streets in any city before the monopolist can add improvements. By contrast, the competitor need only acquire a single property and does not have to monopolize a city by obtaining two of the three properties in the city.

Finally, with respect to the improvement of real properties by the monopolist, if a monopolist has any two city streets in a city while the third city street is owned by a competitor, the monopolist may evict the competitor. Eviction is accomplished by either returning the title card to the banker or treasurer, who pays the competitor the mortgage price, or by buying the property, without improvements, directly from the competitor at an agreed price. A monopolist cannot, however, evict another monopolist. The mortgage value on all of the real properties is one half the purchase price, and the monopolist cannot have improvements in a city if any one of the two properties needed for monopolization is mortgaged. Improvements in the form of houses or hotels on the mortgaged property must be returned to the treasurer for one-half price before the property is mortgaged.

Figure 7:
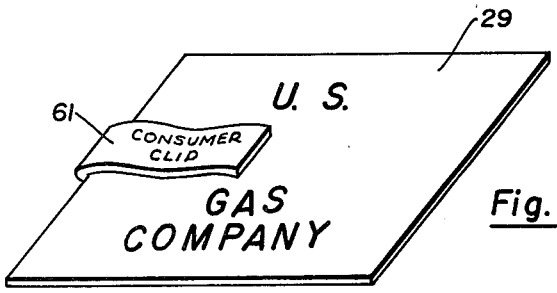
FIG. 7 is a top plan view of a title card for a utility showing a consumer clip mounted thereon.

The game equipment can further optionally include mortgage notes 62 (shown in FIG. 7) which notes can be kept by the treasurer and exchanged when loans are made against the properties. Optionally, as is done with other types of board games, the title cards 29 can simply be turned over to indicate that they have been mortgaged.

Figure 6:
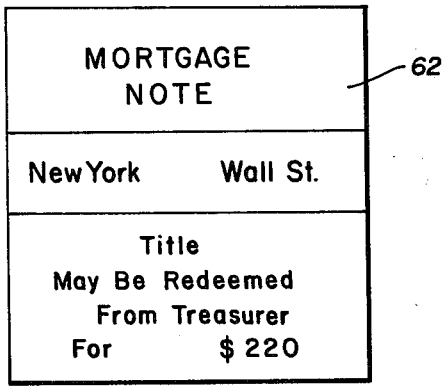
FIG. 6 is a top plan view of a mortgage note.

Spaces 105, 115, 125 and 135 are formed to represent various transportation industries, in this case, railroads, bus lines, airlines and trucking companies. Additionally, spaces 112 and 128 represent electrical companies and gas companies. These utilities and transportation companies have a schedule of rents as is shown in Table 2. In order to facilitate identification, the apparatus of the present invention, as best may be seen in FIG. 6, can optionally include a consumer clip 61 which is placed on the title card 29 for the utility or transport companies by one of the two groups of players, in this case the monopolist.

Table 2

| Space No. | Cost of Acquisition | Rents Charged by Competitor | Rents Charged by No. of Properties Owned 1 | 2 | 3 | 4 |
|---|---|---|---|---|---|---|
| TRANSPORTATION COMPANIES | | | | | | |
| 105 | $200 | $20 | $40 | $80 | $160 | $320 |
| 115 | 200 | 20 | 40 | 80 | 160 | 320 |
| 125 | 200 | 20 | 40 | 80 | 160 | 320 |
| 135 | 200 | 20 | 40 | 80 | 160 | 320 |
| UTILITIES | | | | | | |
| 112 | 150 | 4 X Dice | 4 X Dice | 10 X Dice | — | — |
| 128 | 150 | 4 X Dice | 4 X Dice | 10 X Dice | | |

In addition to the real property, transportation and utility businesses indicated on the board, spaces 22 include spaces (generally designated 43) 102, 107, 117, 122, 133, and 136 which when landed on require the competitor or monopolist to draw one of the detriment or benefit cards 31 and 32. The detriment and benefit cards may confer a wide range of detriments and benefits to the players, but they must be balanced with the rent schedules and other probability determining means so as to cause an equal probability of winning the game. For the purpose of illustration, the detriment and benefit cards include three levels of detriments and three levels of benefits, namely, a small payment of $25, a medium payment of $50, and a heavy payment of $75. In both the monopolist and the competitor cards, there are three cards producing a small payment to the player, three cards producing a medium payment and three cards producing a heavy payment. Additionally, both the monopolist and competitor cards include six cards with two each requiring the player to make small, medium and heavy payments. The monopolist's deck includes two cards directing the monopolist to go to "prison" and two cards which are neutral and award no detriment or benefit. The competitor's deck similarly contains two cards directing the competitor to go to "price war" and two neutral cards not conferring a detriment or a benefit. Each of the competitor's and monopolist's decks further include two cards instructing them to advance to "start," a card directing them to advance to the "electric company," a card directing them to advance to a property, in this case space 103, a card directing them to advance to the airline space, and a card directing them to advance to another property, in this case space 127.

In addition, spaces 104, 120, 130, 138 and 140 also confer detriments or benefits on the players when landed upon. These detriment and benefit spaces on the game board further comprise a part of the probability determining means in that they confer detriments or benefits to the players which may differ depending upon whether or not the player is a competitor or monopolist.

The "price war," "prison" and "sightseeing tour" corner 110 has a different effect on competitors and monopolists. Both competitiors and monopolists will be merely on a sightseeing tour if they land directly on corner 110 at the end of a move. If, however, either the competitor or the monopolist should land on space 130 at the end of a move, or be sent to "prison" or "price war" by a competitor or a monopolist card, then they must position their playing piece in the "prison" portion of corner 110, if they are monopolists, or the "price war" portion of area 110, if they are competitors. While on "price war," competitors continue to collect rents or other charges due them. Monopolists sent to "prison," however, do not collect rents or any other amounts. Monopolists and competitors can get out of "prison" and "price war" on the same basis, namely, by paying $50 to the Anti-Monopoly Foundation or by rolling doubles within three turns, at which point they must pay the $50 and leave "prison" or "price war."

The "income tax" square 104 results in a tax of monopolists of $200 or 20% of their cash value, plus 10% of the listed price of their unmortaged streets, transportion companies and utilities and 10% of the original cost of their improvements. Competitors must only pay 10% of their cash, plus 10% of their properties and improvements.

A player whose playing piece lands on space 120 will also receive different treatment if he is a monopolist than if he is a competitor. The monopolist must pay $160 to the Anti-Monopoly Foundation by placing that amount on the board. A competitor, by constrast, rolls one die and collects $25 if he rolls a "1" and $50 if he rolls a "2." Otherwise, he collects nothing.

Players landing on space 130 are sent to "prison" if they are monopolists and are sent to "price war" if they are competitors.

Players landing on space 138 at the end of their turn must pay a tax of $75 to the treasurer, regardless of whether they are competitors or monopolists.

As above described, the detriments, benefits and playing piece movement affecting instructions have been balanced so that the probability of winning the game as between a player playing as a competitor and a player playing as a monopolist is substantially balanced. If each player plays his respective game theory to the optimum, the outcome will be determined as a matter of chance. Each player will start with an equal chance of winning.

ALTERNATE BALANCED GAMES

The above example shows application of the present invention to a real estate trading game so as to add the dimension of a second, balanced game theory, namely, that of the competitor. In my prior U.S. Pat. No. 3,961,795, a board game is disclosed in which the object is to break up illegal business combinations and earn social credit points through indicting and thereby eliminating these combinations. The present invention may be applied to this type of game so that one player can act as a lawyer from the Justice Department, whose tactics emphasize long term success in breaking up these combinations, while another player or set of players can act as private counsel, who are somewhat less certain to break up the combinations and yet obtain greater social credit points when they do. These two game theories, for example, can be played simultaneously with the probability of winning under either game theory being balanced.

Still a further example of application of the present invention would be a board game of the type in which the game theories of U.S. Pat. No. 2,026,082 and my prior U.S. Pat. No. 3,961,795 were played simultaneously. Thus, one group of players might attempt to create monopolistic combinations and charge disproportionate rents while the other group of players would attempt to break up illegal combinations. The first to land on a property would acquire the same if he were a monopolist or file an indictment if he were a trust-busting lawyer. The detriments, benefits and the like would again be balanced, preferably through computer analysis.

The game theory of the present invention also has application to classic simulation of other dual or multiple roles found in every day life. A partial list of examples might include male versus female; the simulation of combat by players having differing types of weapons or battle strategies; and stock market games with high risk and low risk investment theories, to name a few. As will also be appreciated, the ability to use two different game theories for the simultaneous play of a game wherein the game theories are also balanced to produce an equal probability of winnning could be applied to games other than the traditional board or parlor games. One need only provide a multiplicity of game theories, analyze the parameters or factors which determine the probability of winning, and provide game equipment which balances these factors so that the probability of winning is determined in any one game by chance and not the selection of the game theory under which the game is played. This approach enables a greater flexibility in simulating real life situations and adds to the interest and diversity of the game design which can be created.

What is claimed is:

1. Game equipment including game format means, a plurality of player identification means formed for use with said format means, and probability determining means formed to control play of a game under a first game conduct theory by a first player and to control play of said game under a second different game conduct theory by a second player, said probability determining means being provided on at least one of said format means and reference means associated with said format means, wherein the improvement in said game equipment comprises:

said probability determining means being formed so that the probability of winning said game by said first player playing under said first game conduct theory as controlled by said probability determining means is statistically equal to the probability of winning said game by said second player playing under said second different game conduct theory as controlled by said probability determining means.

2. Game equipment as defined in claim 1 wherein, said game format means is a game board formed with a plurality of spaces forming a continuous path thereon for movement of said player identification means thereover; and said probability determining means includes indicia provided on said reference means and on said game board proximate said spaces, said reference means further including thereon at least one of detriments, benefits and directions for movement of said player identification means which are correlated by said indicia to selected ones of said spaces.

3. Game equipment including a game board having a plurality of spaces delineated thereon, said spaces being arranged in a continuous path; a first playing piece and a second playing piece identifiably different from said first playing piece; playing piece advancement means formed to determine movement of the playing pieces along said path; distinct title indicia positioned on said game board proximate each of a plurality of said spaces; a deck of title cards with one of said title cards for each of said spaces having said distinct title indicia positioned proximate thereto, and each of said title cards having title indicia thereon corresponding to said distinct title indicia; and a first set of directions formed on said deck of title cards whereby a first player can play a game with said game equipment under a first game theory by following said first set of directions; wherein the improvement in said game equipment comprises:

said deck of title cards further being formed with a second set of directions differing from said first set of directions, for simultaneous play of a game by a second player under a second game theory, said second set of instructions on said deck of title cards being formed so that the probability of winning under said second game theory is substantially equal to the probability of winning under said first game theory.

4. Game equipment as defined in claim 3 wherein, said spaces are designated by indicia to represent real property;

said title deck of cards includes said first set of directions in the form of a schedule of rental prices displayed thereon; and said title deck of cards further includes said second set of directions in the form of a differing schedule of rental prices displayed thereon.

5. Game equipment as defined in claim 4 wherein, said spaces designated to represent real property are further designated by indicia to form a plurality of distinguishable groups of real properties representing different cities with each space in said group representing a real property within the same city.

6. Game equipment including a game board having a plurality of spaces delineated thereon, said spaces being arranged in a continuous path; a first playing piece and a second playing piece identifiably different from said first playing piece; playing piece advancement means formed to determine movement of the playing pieces along said path; and improvement means formed for positioning on said game board proximate said spaces during play of a game with said game equipment, wherein the improvement in said game equipment comprises:

at least one of said improvement means and said game board having improvement indicia thereon indicating when said improvement means is being used during play under a first game theory by a first player using said first playing piece, and when said improvement means is being used during play of a second game theory by a second player using said second game piece.

7. Game equipment as defined in claim 6 wherein, said improvement indicia are provided as marked areas on said board for positioning said improvment means with said marked areas being identifiable with one of said first and second game theories.

8. Game equipment including game format means; a plurality of player identification means formed for use with said format means in the play of a game; and probability determining means including, reference means having at least one of benefits, detriments and directions affecting play of said game provided thereon, and indicia means on said format means and formed to indicate when said reference means shall affect play of said game;

wherein the improvement is said game equipment comprises:

said reference means having a first combination of game affecting factors thereon selected from at least one of said detriments, said benefits and said directions for play of said game by a first player under a first game theory;

said reference means further having a second combination of game affecting factors thereon selected from at least one of said detriments, said benefits and said directions on said reference means for play of a game by a second player under a second game theory identifiably different from said first game theory;

said second combination of factors on said reference means differing from said first combination of factors on said reference means;

said indicia on said game format means including indicia corresponding to said first combination of factors and indicia corresponding to said second combination of factors; and said first combination of factors and second combination of factors each being selected to produce an equal probability of winning said game under said first game theory and under said second game theory.

9. Game equipment including a game board having a plurality of spaces delineated thereon, said spaces being arranged in a continuous path; first and second player identification means provided by identifiably different playing pieces each formed for movement along said path; playing piece advancement means formed to determine movement of said playing pieces along said path; and first probability determining means in the form of, indicia on said game board, and reference means for use with said game board having indicia thereon correlated to indicia on said game board and having a first set of directions, benefits and detriments inprinted thereon to determine with said advancement means the manner of movement of a first of said playing pieces by a first player along said path and the benefits and detriments received by said first player during play of a game under a first game theory, wherein the improvement in said game equipment comprises:

second probability determining means formed to control movement of a second of said playing pieces by a second player along said path during play of a game under a second game theory simultaneously with play of a game on said game equipment under said first game theory, said second probability determining means being formed as second indicia on said game board and a second set of directions, benefits and detriments imprinted on said reference means and correlated to said second indicia, said second set of directions, benefits and detriment differing from said first set of directions, benefits and detriments to determine, with said advancement means, the manner of movement of said second playing piece and the benefits and detriments received by said second player during play of a game under said second game theory which differs from said first game theory, said first probability determining means and said second probability determining means each having directions, benefits and detriments selected to produce a statistically equal probability of winning under said first game theory and said second game theory.

10. Game equipment as defined in claim 9 wherein, said spaces are designated to represent business entities;

said first set of directions, benefits and detriments includes a first set of benefits accruing upon reducing an anti-competitive activity of said business entities; and said second set of directions, benefits and detriments includes a second set of benefits, differing from said first set of benefits, accruing upon reducing an anti-competitive activity of said business entities.

11. Game equipment as defined in claim 9 wherein, selected of said spaces are formed with detriment and benefit indicia associated therewith;

said reference means further includes detriment and benefit cards having at least one of a detriment and a benefit indicated thereon for use in the play of said first game theory, said detriment and benefit cards further including cards having at least one of a detriment and a benefit indicated thereon for use in the play of said second game theory, and said detriment and benefit cards further having indicia thereon correlating each of said detriment and benefit cards to one of said first game theory and said second game theory.

12. Game equipment as defined in claim 11 wherein, said detriment and benefit cards is provided by a first detriment and benefit deck for play under said first game theory and a second detriment and benefit deck for play under said second game theory.

* * * * *